US007712214B2

(12) United States Patent
Clark et al.

(10) Patent No.: US 7,712,214 B2
(45) Date of Patent: May 11, 2010

(54) METHOD OF ASSEMBLING A PATCH CORD HAVING A THREADED CONNECTOR

(75) Inventors: Gordon Clark, Eden Prairie, MN (US); Loren Mattson, Richfield, MN (US); Douglas G. Elliot, Waconia, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 12/156,402

(22) Filed: May 30, 2008

(65) Prior Publication Data

US 2008/0233794 A1 Sep. 25, 2008

Related U.S. Application Data

(63) Continuation of application No. 11/511,893, filed on Aug. 29, 2006, now Pat. No. 7,413,466.

(51) Int. Cl.
*H01R 43/00* (2006.01)

(52) U.S. Cl. ..... 29/857; 29/868; 174/27; 439/583

(58) Field of Classification Search ..... 29/857, 29/861, 863, 866, 868, 33 F; 174/27, 74 R, 174/113 R; 439/392, 418, 434, 461, 583
See application file for complete search history.

(56) References Cited

U.S. PATENT DOCUMENTS

| | | | | |
|---|---|---|---|---|
| 835,003 | A | 11/1906 | Svensson | |
| 2,434,475 | A | 1/1948 | Sullivan | |
| 2,552,414 | A | 5/1951 | Eriksen et al. | |
| 3,001,169 | A | 9/1961 | Blonder | |
| 3,601,766 | A | 8/1971 | Alibert | |
| 3,710,005 | A | 1/1973 | French | |
| 4,408,822 | A | 10/1983 | Nikitas | |
| 5,195,906 | A | 3/1993 | Szegda | |
| 5,389,012 | A | 2/1995 | Huang | |
| 5,393,244 | A | 2/1995 | Szegda | |
| 5,531,618 | A * | 7/1996 | Market | 439/434 |
| 5,877,452 | A | 3/1999 | McConnell | |
| 6,017,237 | A * | 1/2000 | Sullivan | 439/418 |
| 6,019,635 | A | 2/2000 | Nelson | |
| 6,293,824 | B1 | 9/2001 | Guerin et al. | |
| 6,323,427 | B1 | 11/2001 | Rutledge | |
| 6,371,794 | B1 | 4/2002 | Bauer et al. | |
| 6,439,911 | B1 | 8/2002 | Conorich | |
| 6,495,755 | B2 | 12/2002 | Burton et al. | |
| 6,840,803 | B2 | 1/2005 | Wlos et al. | |
| 7,115,815 | B2 | 10/2006 | Kenny et al. | |
| 7,144,272 | B1 | 12/2006 | Burrs et al. | |

(Continued)

OTHER PUBLICATIONS

U.S. Appl. No. 11/473,370, *Twisted Pairs Cable with Shielding Arrangement*, pp. 1-24, filed Jun. 22, 2006.

(Continued)

*Primary Examiner*—Donghai D. Nguyen
(74) *Attorney, Agent, or Firm*—Merchant & Gould P.C.

(57) ABSTRACT

A patch cord including a connector attached to an end of a multi-pair cable. The connector including a threaded arrangement that engages a jacket of the multi-pair cable to secure the connector relative to the end of the multi-pair cable.

15 Claims, 6 Drawing Sheets

U.S. PATENT DOCUMENTS

| | | | |
|---|---|---|---|
| 7,173,189 | B1 | 2/2007 | Hazy et al. |
| 7,413,466 | B2 | 8/2008 | Clark et al. |
| 2003/0199192 | A1 | 10/2003 | Caveney et al. |
| 2005/0087357 | A1 | 4/2005 | Steinich |
| 2005/0092515 | A1 | 5/2005 | Kenny et al. |
| 2005/0106929 | A1 | 5/2005 | Meckley et al. |
| 2005/0153603 | A1 | 7/2005 | AbuGhazaleh et al. |
| 2007/0144762 | A1 | 6/2007 | Stutzman et al. |

OTHER PUBLICATIONS

U.S. Appl. No. 11/471,982, *Multi-Pair Cable with Varying Lay Length*, pp. 1-28, filed Jun. 21, 2006.

* cited by examiner

METHOD OF ASSEMBLING A PATCH CORD HAVING A THREADED CONNECTOR

CROSS-REFERENCE TO RELATED APPLICATIONS

This application is a continuation application of U.S. application Ser. No. 11/511,893, filed Aug. 29, 2006, now U.S. Pat. No. 7,413,466; which application is incorporated herein by reference.

TECHNICAL FIELD

The present disclosure relates generally to cables for use in the telecommunications industry, and various methods associated with such cables. More particularly, this disclosure relates to telecommunication patch cords.

BACKGROUND

The telecommunications industry utilizes cabling in a wide range of applications. Some cabling arrangements include twisted pairs of insulated conductors, the pairs being twisted about each other to define a twisted pair core. An insulating jacket is typically extruded over the twisted pair core to maintain the configuration of the core, and to function as a protective layer. Such cabling is commonly referred to as a multi-pair cable.

Multi-pair cables are used in many applications; for example, patch cords often utilize multi-pair cables. Patch cords include connectors secured to each end of a multi-pair cable and are used to provide electrical interconnections between two pieces of equipment. The connectors are typically clamped onto the ends of the multi-pair cable.

Conventional patch cord connectors, such as RJ45 type connectors, often cannot meet the stringent electrical requirements associated with high speed signal transmission applications. Such electrical requirements can concern, for example, alien crosstalk arising from high speed signal transmissions. In most cases, the inability to meet the electrical requirements is due at least in part to inadequate retention of the connector in relation to the cable and/or cable jacket. Inadequate retention of the connector causes distortion in both the twisted pair core as well as the individual pairs of the multi-pair cable, which in turn adversely affects electrical performance.

To address the above retention problem, some more recent connector arrangements include additional securing components. The additional securing components, however, increase the manufacturing cost of both the connector and the cable in terms of added materials, machining or molding, and assembly.

In general, improvement has been sought with respect to such connector and cable arrangements, generally to improve attachment of a connector to a multi-pair cable, and related assembly processes.

SUMMARY

One aspect of the present disclosure relates to a patch cord. The patch cord includes a connector attached to an end of a multi-pair cable. The connector includes a threaded arrangement that engages a jacket of the multi-pair cable. Still another aspect of the present disclosure relates to a method of assembling a patch cord having a connector with a threaded arrangement. A further aspect of the present disclosure relates to a multi-pair cable connector having a threaded retention arrangement for retaining the connector on a multi-pair cable.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

A. Introduction

In general, the present disclosure relates to a connector having a unique screw-on retention arrangement that retains the connector in relation to an end of a cable. The unique retention arrangement makes the connector easy to assemble onto a multi-pair cable, requires no additional parts, and does not adversely affect the electrical performance of the cable's core or twisted pairs.

As will be described in greater detail hereinafter, the retention arrangement of the presently disclosed connector includes an internal helix type thread that easily screws onto an outer jacket of a cable. The outer jacket can be a double-layer jacket or a single-layer jacket. The connector is designed to evenly distribute radial forces on the outer jacket of the cable without disturbing the cable core or the individual twisted pairs. The unique internal helix type thread provides a connector retention arrangement that meets the electrical requirements for high speed signal transmissions established by the industry. As will also be described in greater detail hereinafter, the inner diameter of the helix type thread is slightly smaller than the jacket diameter of the cable. In addition to providing improved connector retention, this design also has the affect of deforming the outer jacket with a screw thread indentation to further provide a secure strain relief feature.

Figure 1:
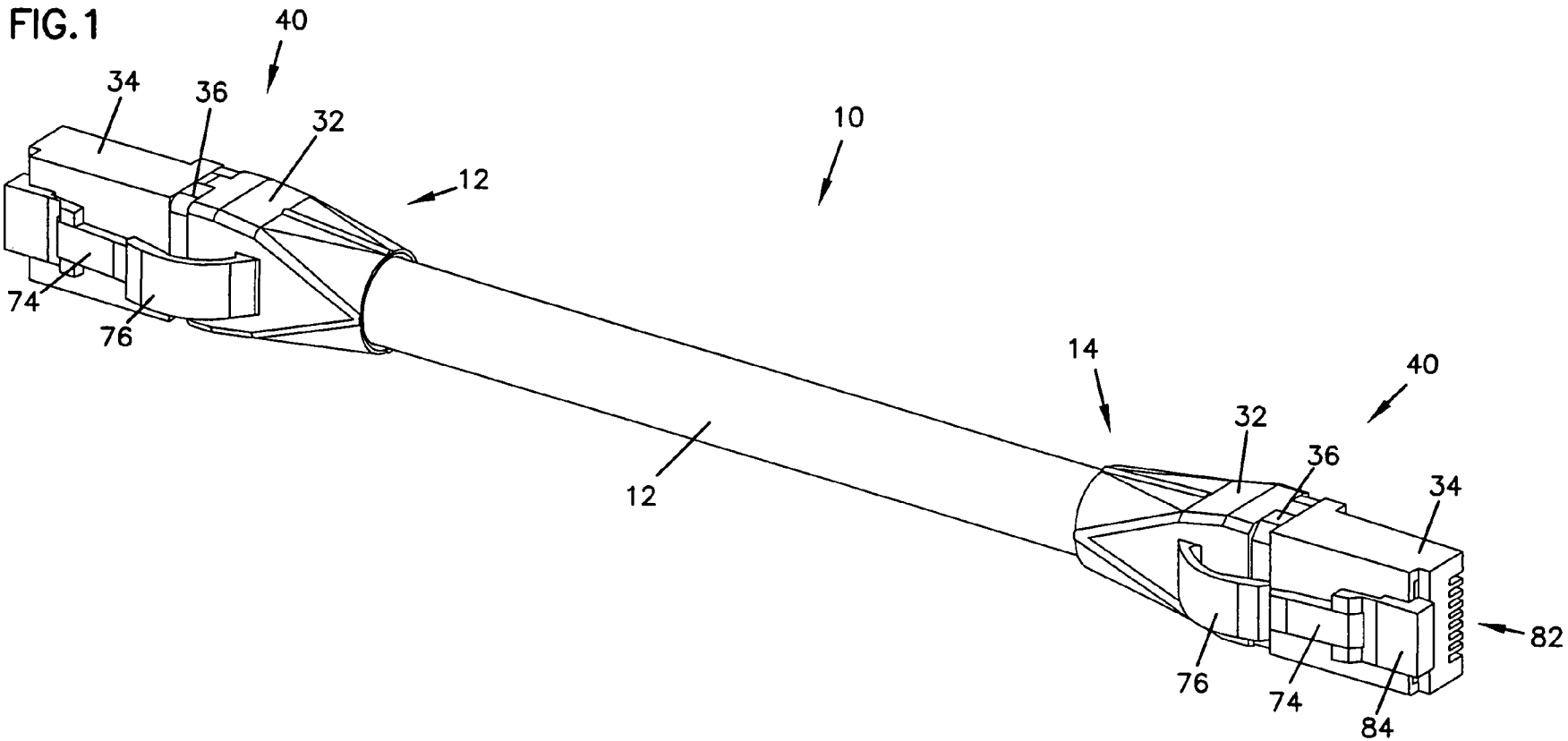
FIG. 1 is a perspective view of one embodiment of a patch cord, including a multi-pair cable and connectors, in accordance with the principles of the present disclosure.

Referring to FIG. 1, one embodiment of a patch cord 10 having features that are examples of how inventive aspects of the present disclosure may be practiced, is illustrated. The patch cord 10 generally includes a cable 12 having a first end 14 and a second end 16. First and second connectors 40 are attached to the ends 14, 16 of the cable 12.

B. Multi-Pair Cable, Generally

Figures 2, 3, 4, 5:
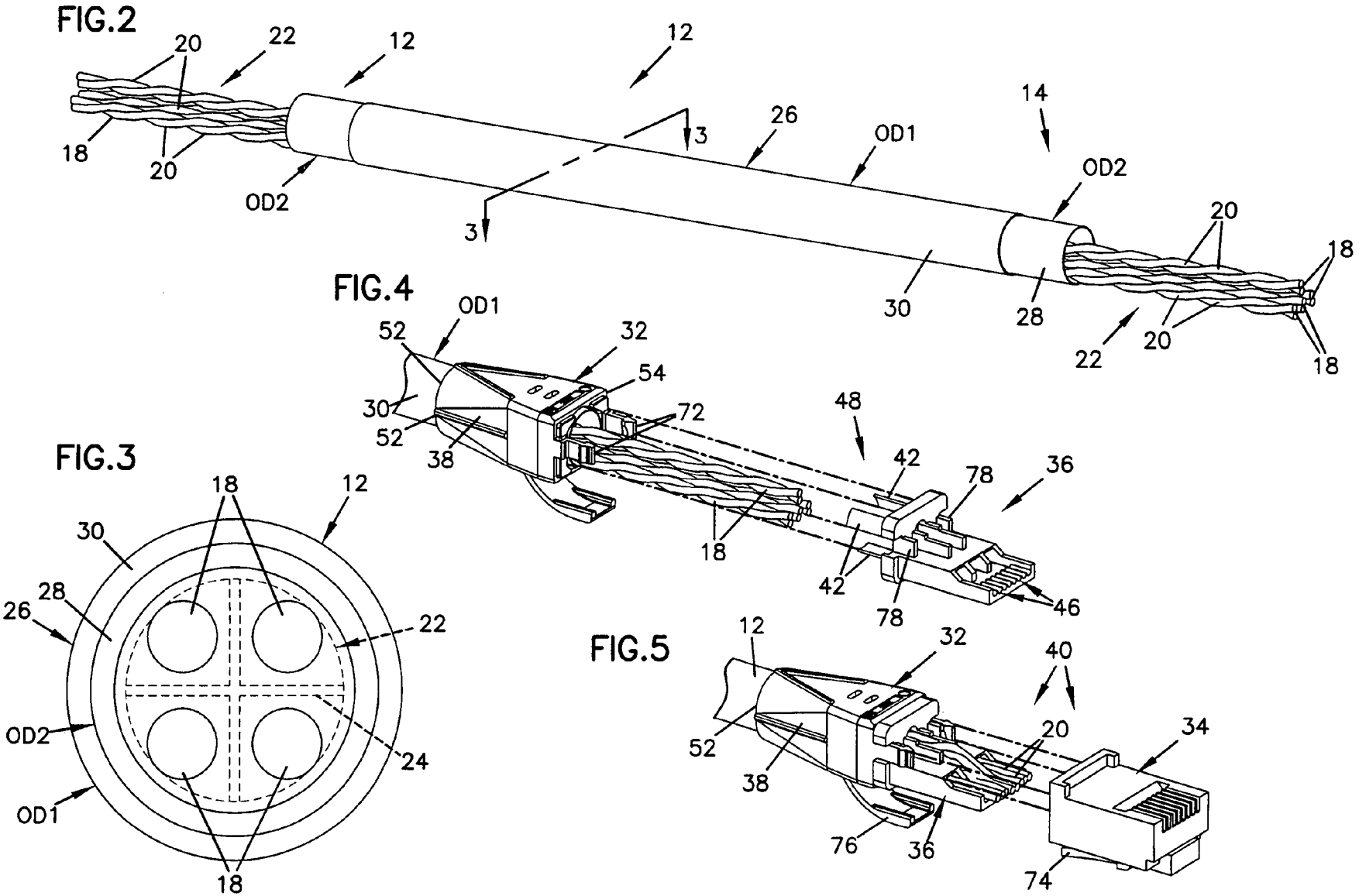
FIG. 2 is a perspective view of the multi-pair cable of the patch cord of FIG. 1, shown in isolation.
FIG. 3 is a schematic, cross-sectional view of the multi-pair cable of FIG. 2, taken along line 3-3.
FIG. 4 is an exploded, perspective view of a portion of one of the connectors of FIG. 1.
FIG. 5 is an exploded, perspective view of one of the connectors of FIG. 1.

Referring to FIGS. 2 and 3, the cable 12 of the presently disclosed patch cord 10 includes a plurality of twisted pairs 18. In the illustrated embodiment, the cable 12 includes four twisted pairs 18. Each of the four twisted pairs includes first and second insulated conductors 20 twisted about one another along a longitudinal pair axis. The electrical conductors of the insulated conductors 20 may be made of copper, aluminum, copper-clad steel and plated copper, for example. It has been found that copper is an optimal conductor material. In one embodiment, the conductors are made of braided copper. One example of a braided copper conductor construction that can be used is described in greater detail in U.S. Pat. No. 6,323,427, which is incorporated herein by reference. In addition, the conductors may be made of glass or plastic fiber such that a fiber optic cable is produced in accordance with the principles disclosed. The insulating layer of the insulated conductors 20 can be made of known materials, such as fluoropolymers or other electrical insulating materials, for example.

The plurality of twisted pairs 18 of the cable 12 defines a cable core 22. In the illustrated embodiment of FIG. 2, the core 22 includes only the plurality of twisted pairs 18. In alternative embodiments, the core may also include a spacer that separates or divides the twisted pairs 18. FIG. 3 illustrates one example of a star-type spacer 24 (represented in dashed lines) that can be used to divide the four twisted pairs 18. Other spacers, such as flexible tape strips or fillers defining pockets and having retaining elements that retain each of the twisted pairs within the pockets, can also be used. Additional spacer examples that can be used are described in U.S. patent application Ser. Nos. 10/746,800, 10/746,757, and 11/318,350; which applications are incorporated herein by reference.

Figure 6:
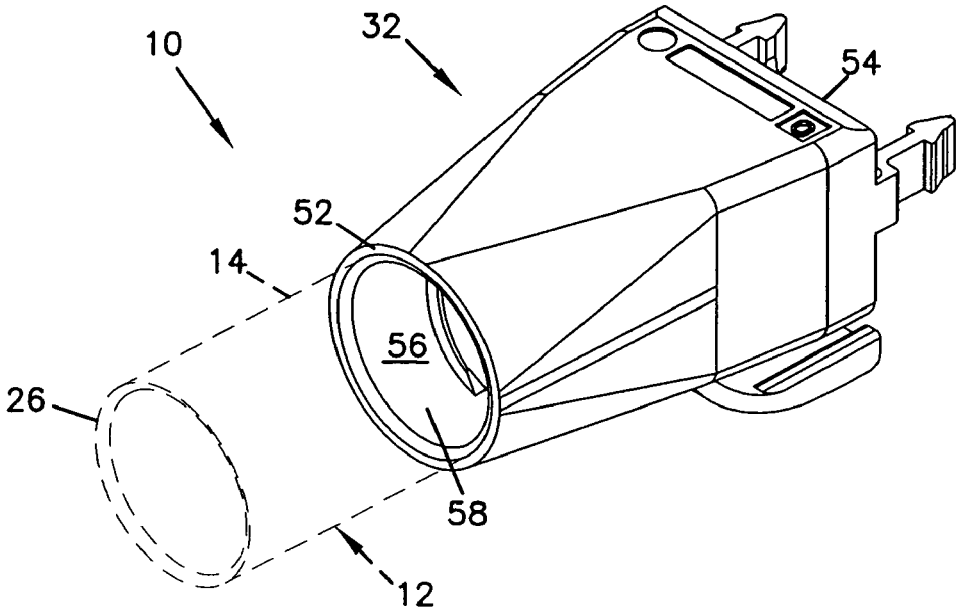
FIG. 6 is a perspective view of one embodiment of a first connector piece of the connectors of FIG. 1, in accordance with the principles of the present disclosure, shown in isolation.

Referring still to FIGS. 2 and 3, the cable 12 includes a jacket 26 that surrounds the core 22 of twisted pairs 18. In the illustrated embodiment, the jacket 26 is a double jacket having both a first inner jacket 28 and a second outer jacket 30. The inner jacket 28 surrounds the core 22 of twisted pairs 18. The outer jacket 30 surrounds the inner jacket 28. The inner and outer jackets 28, 30 function not only to maintain the relative positioning of the twisted pairs 18, but also to lessen the occurrence of alien crosstalk. In an alternative embodiment, as schematically represented in FIG. 6, the jacket 26 can be a single layer jacket. In the illustrated embodiment of FIGS. 1-3, the outer jacket 30 has an outer diameter OD1 of between about 0.305 inches and 0.315 inches. The inner jacket 28 has an outer diameter OD2 of between about 0.236 and 0.250 inches.

The inner jacket 28 and the outer jacket 30 of the present cable 12 can be made from similar materials, or can be made of materials different from one another. Common materials that can be used to manufacture the inner and outer jackets include plastic materials, such as fluoropolymers (e.g. ethylenechlorotrifluorothylene (ECTF) and Flurothylenepropylene (FEP)), polyvinyl chloride (PVC), polyethylene, or other electrically insulating materials, for example. In addition, a low-smoke zero-halogen material, such as polyolefin, can also be used. While these materials are used because of their cost effectiveness and/or flame and smoke retardancy, other materials may be used in accordance with the principles disclosed.

In one embodiment, each of the twisted pairs 18 of the cable 12 has a twist rate and associated lay length different from that of the other twisted pairs. This type of arrangement aids in reducing crosstalk between the pairs of the cable core 22. The cable core 22 of the cable 12 also has a cable twist rate and associated cable lay length. Various twisted pairs lay length arrangements and cable core lay lengths can be utilized in accordance with the present disclosure. Some example arrangements are described in U.S. patent application Ser. No. 11/471,982; which application is incorporated herein by reference. Additional cable arrangements having other example pair and cable lay length arrangements that can be used are described in U.S. patent application Ser. Nos. 10/746,800, 10/746,757, 11/318,350, 11/268,681, and 11/473,370; which applications are incorporated herein by reference.

C. Connector with Threaded Arrangement

Referring back to FIG. 1, the first and second connectors 40 of the present patch cord 10 are each attached to the ends 12, 14 of the cable 12. In the illustrated embodiment, the connectors are plug-type connectors, however, the connectors can also include jack-type connectors. Each of the connectors 40 generally includes a first connector piece 32, a second connector piece 34, and a wire management insert 36. In one embodiment, the connector 40, and each of the components (e.g. 32, 34, 36) making up the connector is made of polycarbonate. Other materials can also be used in the making of the connector.

Referring now to FIGS. 4 and 5, the first connector piece 32 of the present connector 40 includes a tapering portion 38 located at a first end 52 of the first connector piece 32. The tapering portion 38 has a boot-like construction that is sized to fit around the outer diameter OD1 of the outer jacket 30 (see also FIG. 1). While the portion 38 shown in the illustrated embodiment has a tapering construction, the first end 52 of the first connector piece 32 can be configured with various non-tapering constructions as well.

Figure 7:
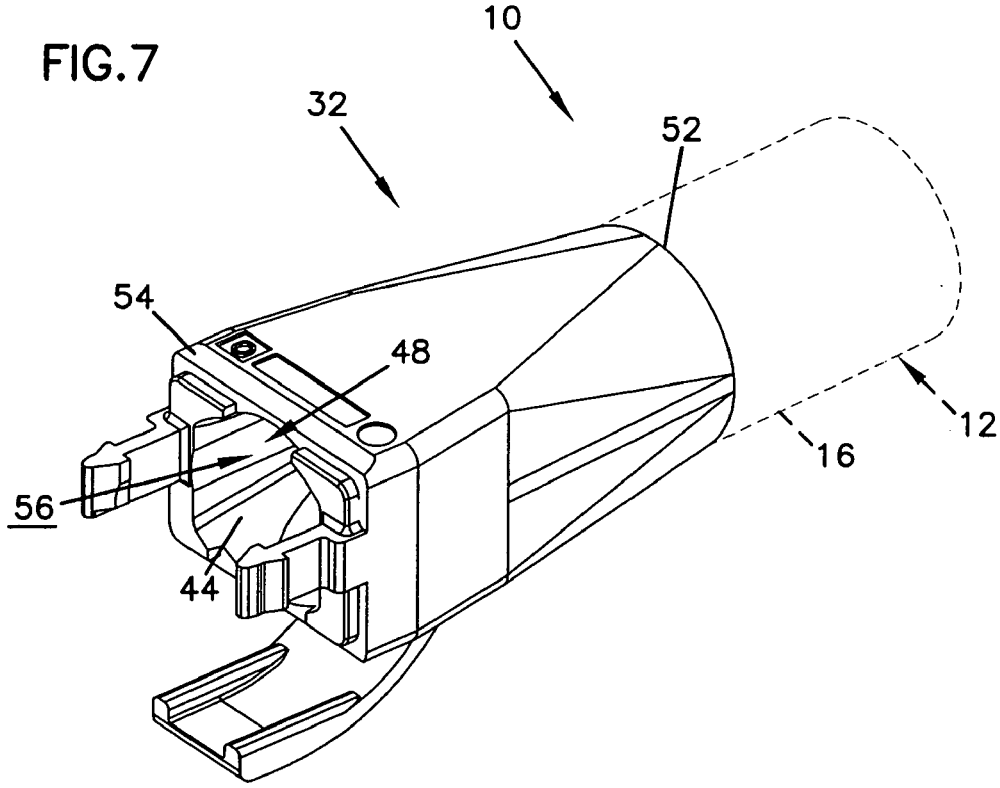
FIG. 7 is another perspective view of the first connector piece of the connectors of FIG. 1, shown in isolation.

As shown in FIGS. 6 and 7, the first connector piece 32 of the connector 40 has an inner diameter surface 58 (see also FIG. 9) that defines a through bore 56. The through bore 56 extends from the first end 52 of the first connector piece 32 to a second end 54 of the first connector piece 32. The plurality of twisted pairs 18 (FIG. 4) extends through the through bore 56 of the first connector piece 32 when the tapering portion 38 of the first connector piece 32 is placed around the end of the cable 12.

In one embodiment, the inner diameter surface 58 of the first connector piece 32 has a diameter ID3 (FIG. 9) of about 0.312 inches, and the outer diameter OD1 of the outer jacket 30 received within the diameter ID3 of the first connector piece 32 is about 0.310 inches. Accordingly, there is little to no interference fit, and sometimes even annular space, between the first connector piece 32 and the cable jacket 30. The present connector 40 is designed, however, to ensure that the attachment between the first connector piece 32 and the cable jacket is secure. In particular, the present connector 40 includes both a clamping arrangement 48, as well as a threaded arrangement 50, that maintains a fixed attachment of the connector 40 to the cable 12.

Referring again to FIG. 2, in assembly of the patch cord 10 having the cable 12 with the double jacket 26, a portion of the outer jacket 30 is first striped away in preparation for receipt of the connector 40. As will be described in greater detail hereinafter, the first connector piece 32 of the connector 40 is then threaded onto the end of the cable 12 via the threaded arrangement 50. With the first connector piece 32 secured, the wire management insert 36 is then secured to the cable 12 via the clamping arrangement 48.

Figure 8:
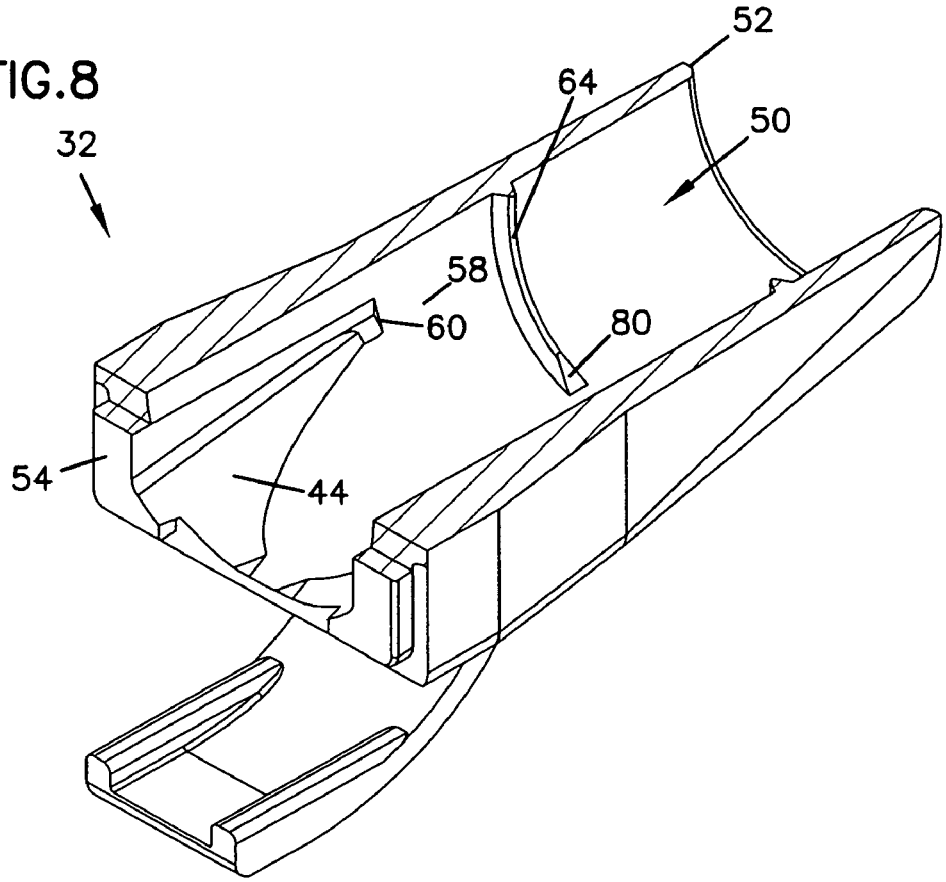
FIG. 8 is a perspective view of a portion of the first connector piece of FIGS. 6 and 7.
Figure 9:
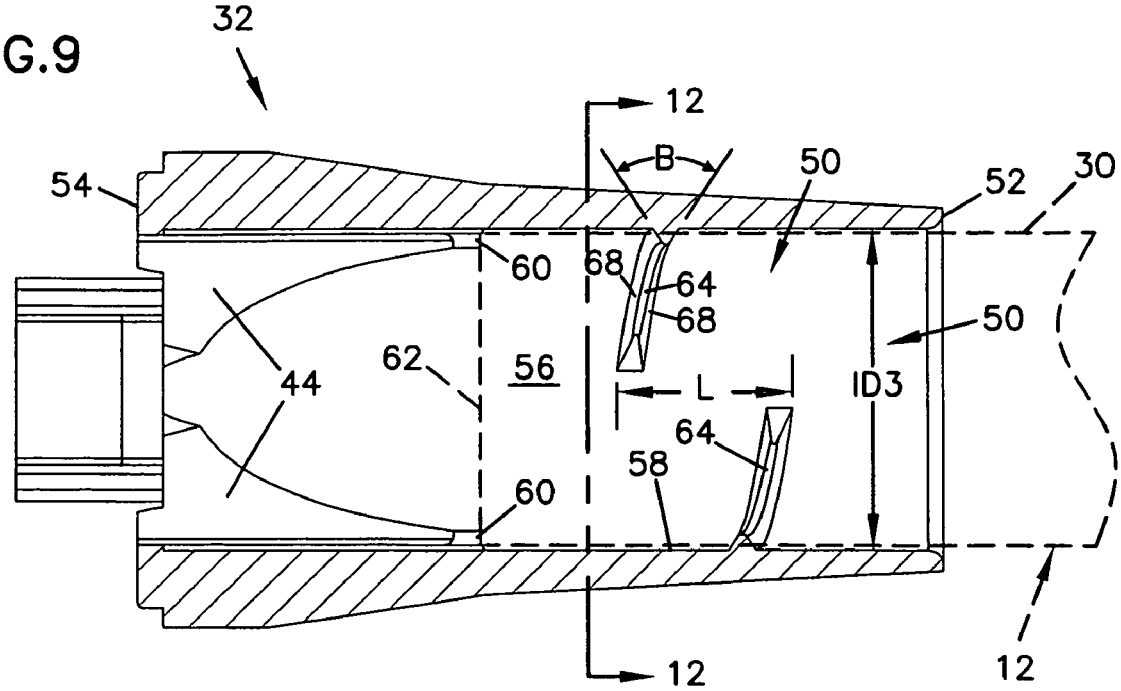
FIG. 9 is a cross-sectional view of the first connector piece of FIG. 8.

Referring to FIGS. 4 and 7, the clamping arrangement 48 involves the interaction of each of the first connector piece 32 and the wire management insert 36. In particular, the wire management insert 36 of the connector 40 includes a number of flexible prongs 42 (FIG. 4). The first connector piece 32 includes ramped interior surfaces 44 (FIG. 7; see also FIGS. 8-9). When the prongs 42 of the wire management insert 36 are inserted within the first connector piece 32, the prongs 42 contact the ramped interior surfaces 44 of the first connector piece 32 and are radially biased inward. This causes the prongs 42 to clamp around the outer diameter OD2 of the inner jacket 28.

The internal threaded arrangement 50 (FIGS. 8 and 9) of the present first connector piece 32 improves upon the relative attachment of the connector 40 and the cable 12 provided by the clamping arrangement 48. Improvement of connector attachment is provided without increasing the clamping force imparted on the core 22 or twisted pairs 18 of the cable. Increasing the clamping force can cause undesired displacement or distortion of the core and twisted pairs. The threaded arrangement 50 of the present connector 40 instead provides a threaded connection between the connector 40 and the jacket 26 of the cable 12, imparting an evenly distributed radial force onto the jacket 26 without disturbing or distorting the cable core 22. The threaded arrangement 50 prevents inadvertent longitudinal movement (i.e. non-threading axial movement) of the connector 40 relative to the cable 12 of the patch cord 10.

Referring to FIGS. 8-11, in the illustrated embodiment, the threaded arrangement 50 includes a plurality of discrete helical elements 64 (e.g., threaded members) disposed on the inner surface 58 of the first connector piece 32. To assemble the patch cord 10, the first connector piece 32 is first twisted or threaded onto one of the ends (e.g., 14) of the cable 12 such that the helical elements 64 engage (e.g., embed into) the outer jacket 30 of the cable 12.

The first connector piece 32 is threaded onto the end (e.g., 14) of the cable 12 until an edge 62 (FIG. 9) of the outer jacket 30 contacts/abuts a shoulder or stop 60 located within the through bore 56 of the first connector piece 32. In the illustrated embodiment, multiple stops 60 are provided within the through bore 56 of the first connector piece 32. The stops 60 limit the longitudinal depth of threaded engagement between the first connector piece 32 and the cable 12. Engagement between the helical elements 64 of the threaded arrangement 50 and the jacket 26 of the cable 12 prevents inadvertent longitudinal movement of the connector 40 relative to the cable 12. The threaded arrangement 50 of the connector 40 provides a more secure attachment of the connector 40 to the cable 12 than that provided by only the clamping force of the prongs 42.

Another feature of the threaded arrangement 50 of the present connector 40 relates to improved patch cord assembly processes. No additional tools or fasteners are required to secure the first connector piece 32 to the cable 12 of the patch cord 10. In addition, the helical elements 64 of the threaded arrangement 50 define a thread pitch and a thread length L (FIG. 9) that provide quick threaded attachment to reduce the time required to assembly a patch cord.

Figure 10:
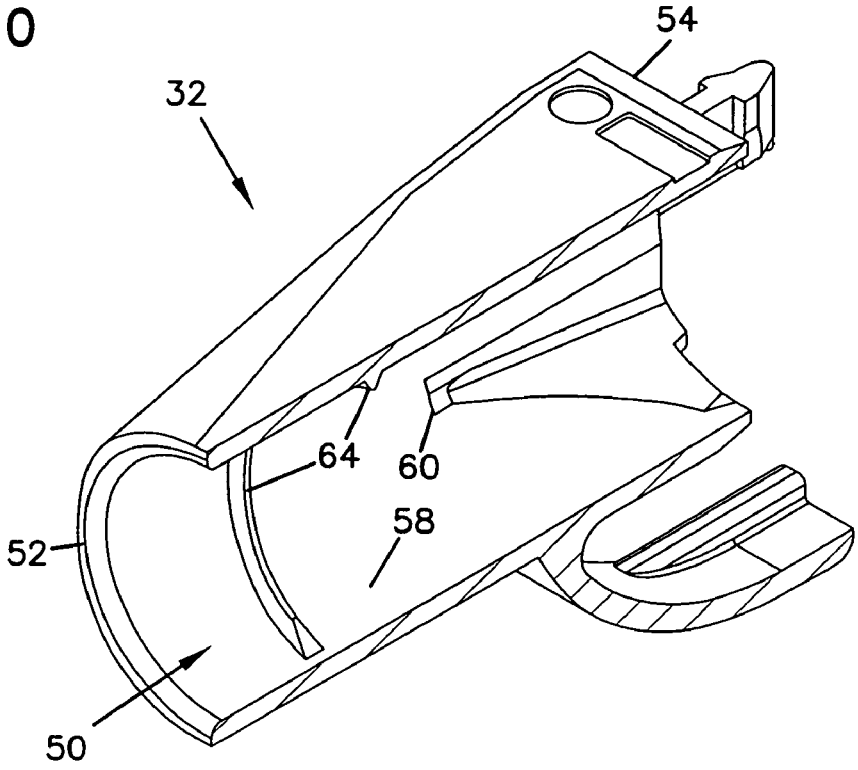
FIG. 10 is a perspective view of another portion of the first connector piece of FIGS. 6 and 7.
Figure 11:
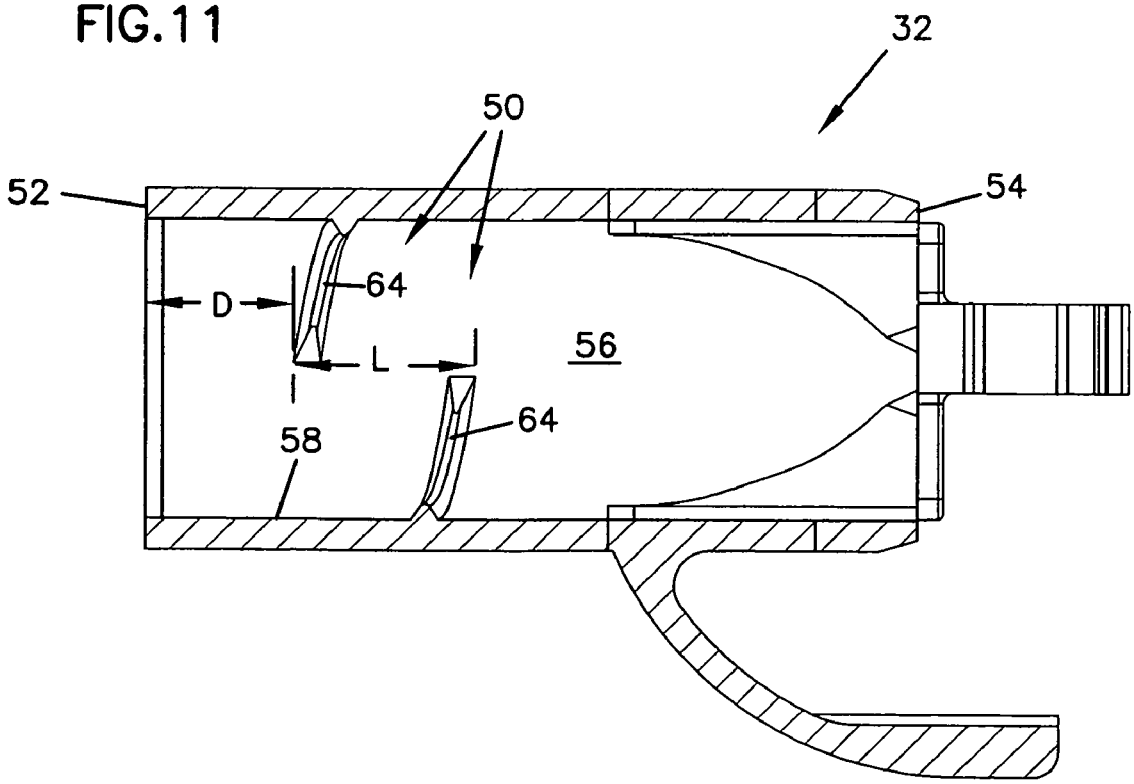
FIG. 11 is a cross-sectional view of the first connector piece of FIG. 10.

In particular, referring to FIGS. 10 and 11, the pitch of the threaded arrangement 50 is designed to longitudinally advance the connector 40 a distance per turn such that threading action is minimized. The pitch of the disclosed threaded arrangement 50 is preferably less than 8 threads per inch. In addition, the length L (FIG. 11) of the threaded arrangement 50 is located in a central region of the through bore 56 (i.e., the threads start at an offset distance D from the first end 52 of the first connector piece 32). It is to be understood that the length L is defined as the entire length of the threaded arrangement 50. The offset distance D provides an un-threaded lead-in into which the outer jacket 30 can be axially inserted before reaching the threads. The un-threaded lead-in distance D maintains alignment between the first connector piece 32 and the outer jacket 30 as the connector piece 32 is initially threaded onto the cable 12.

The threaded arrangement 50 is centrally located so that the assembler need not thread the entire connector length onto the cable end. The length L of the threaded arrangement 50 is long enough to provide sufficient engagement with the jacket 26 to prevent inadvertent longitudinal movement of the connector 40, but short enough so as to not produce a burdensome effect on assembly time. The present threaded arrangement 50 minimizes the threading action to reduce the time required to assembly the patch cord cable 10.

Figure 12:
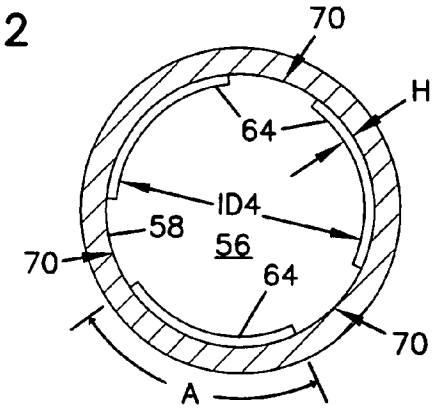
FIG. 12 is a cross-sectional view of the first connector piece of FIG. 9, taken along line 12-12.

Referring to FIG. 12, the threaded arrangement 50 includes three, discrete, helical elements 64. Each helical element 64 has a tapered lead-in 80 (FIG. 8) at one end. The tapered lead-ins 80 facilitate embedding of the helical elements 64 into the outer jacket 30, thereby making it easier to screw the first connector piece 32 onto the cable 12.

Still referring to FIG. 12, gaps 70 separate each of the helical elements 64 such that each element 64 extends only partly around the inner diameter surface 58 of the first connector piece 32. The discrete elements 64 are angularly spaced at approximately the same distance from one another. In a preferred embodiment, the total thread angle A traversed by each helical element 64 along the length L, as the helical element extends around the inner diameter surface 58, is less than or equal to 360 degrees. Limiting the total thread angle A to less than or equal to 360 degrees makes it easier to mold the first connector piece 32 because the helix elements do not overlap when viewed in an axial direction. In an alternative embodiment, the threaded arrangement can be provided without gaps such that the elements 64 define a continuous helix construction.

In the illustrated embodiment, the helical elements 64 are designed to provide an engagement with the jacket 26 sufficient enough to prevent longitudinal movement of the connector 40 relative to the cable 12; however, the engagement is not so deep as to cut into or expose the cable core 22 of the cable 12. As shown in FIG. 12, each of the helical elements 64 has a height H measured from the interior diameter surface 58 to a threaded inside diameter ID4 defined by the helical elements 64. In one embodiment, the height H (i.e., the thread depth) of the helical elements 64 is between about 0.01 inches and 0.025 inches; in another embodiment, the height H is between about 0.015 and 0.02 inches. In some embodiments, the height H is 0.025 inches, or 0.02 inches, or 0.017 inches. Sides 68 of the helical elements 64 define an angular slope B (FIG. 9). In certain embodiments, the angular slope B is between about 50 degrees and 70 degrees. In the illustrated embodiment, the angular slope B is about 60 degrees.

In addition to improving attachment between the connector 40 and the jacket 26 of a patch cord 10, the presently disclosed threaded arrangement 50 of the first connector piece 32 further deforms or displaces the jacket 26 of the patch cord cable 12 with a helix type thread. This has the effect of providing a secure strain relief feature to better accommodate flexure and overall utilization of the patch cord 10.

Figure 13:
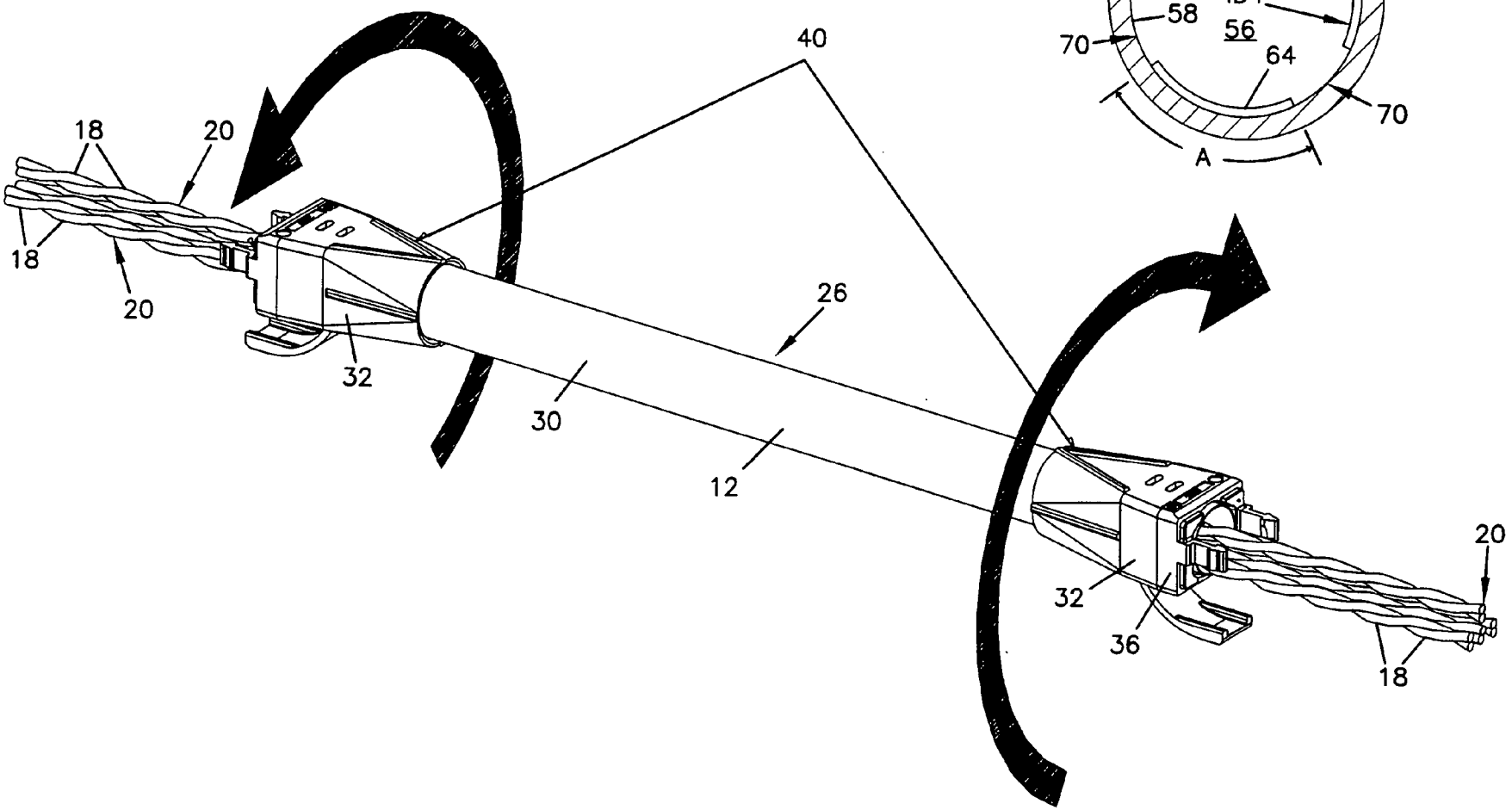
FIG. 13 is a perspective view of the multi-pair cable of the patch cord of FIG. 1, shown with first connector pieces threaded on ends of the multi-pair cable.

In general, to assembly the present patch cord 10, the end portions of the outer jacket 30 are stripped away as shown in FIG. 2. The first connector piece 32 is then threaded onto the outer jacket 30 in the direction shown in FIG. 13. In particular, the first connector piece 32 is threaded in the direction shown until the outer jacket 30 abuts the stops 60 (FIGS. 8 and 9) and the inner jacket 28 is generally flush with the end 54 of the first connector piece 32. When the first connector piece 32 is securely attached to the end of the cable 12 by this threading process, the twisted pairs 18 extend through the through bore 56 of the first connector piece 32 (see FIG. 4). The twisted pairs 18 are then positioned within apertures (not shown) of the wire management insert 36; and the wire management insert 36 is attached to the first connector piece 32 and cable end. When the wire management insert 36 is attached to the first connector piece 32, the inner jacket 28 is clamped by the flexible prongs 42 of the wire management insert 36.

With the first connector piece 32 and wire management insert 36 attached to the cable end, the conductors 20 of the twisted pairs 18 are un-twisted and individually placed within parallel channels 46 of the wire management insert 36. The conductors 20 are then trimmed, as shown in FIG. 5. Next, the second connector piece 34 is connected to the first connector piece 32. The second connector piece 34 includes eight contacts (not shown) located to correspondingly interconnect with the eight insulated conductors 20 of the twisted pairs 18. The eight contacts of the second connector piece 34 include insulation displacement contacts that make electrical contact with the conductors 20. In the illustrated embodiment, the second connector piece 34 defines a plug having a connection interface 82 (FIG. 1). A snap-fit latch 84 is provided on the second connector piece 34 for attachment of the patch cord 10 to a corresponding jack or other structure/equipment.

Each of the first connector piece 32, the second connector piece 34, and the wire management insert 36 includes structure that provides a snap-fit connection between one another. When the first connector piece 32 is attached to the end of the cable, as shown in FIG. 4, the wire management insert 36 is snap fit to the first connector piece 32. In particular, flexible elements 72 of the first connector piece 32 engage with corresponding structure 78 of the wire management insert 36 to provide a first snap-fit connection therebetween. As shown in FIG. 5, with the wire management insert 36 snap fit to the first connector piece 32, the second connector piece 34 is then snap fit to the first connector piece 32. The second connector piece 34 and the first connector piece 32 have corresponding latching structures 74, 76 (see also FIG. 1) that provide a second snap-fit connection therebetween.

In an alternative patch cord embodiment, the connector can be attached to the end of a cable having only a single-layer jacket. In such an embodiment, the clamping arrangement, e.g., the prongs of the wire management insert, can be eliminated due to the absence of an inner jacket. The threaded arrangement of the connector would thereby be the only attachment mechanism between the connector and the cable. Moreover, because the threads of the present threaded arrangement 50 provide secure retention, prongs of a connector can be eliminated even if an inner jacket is present.

The above specification provides a complete description of the present invention. Since many embodiments of the invention can be made without departing from the spirit and scope of the invention, certain aspects of the invention reside in the claims hereinafter appended.

What is claimed is:

1. A method of assembling a patch cord, the method comprising the steps of:

a) providing a multi-pair cable including a plurality of twisted pairs and a jacket surrounding the twisted pairs;

b) providing a connector having a through bore;

c) inserting an end of the multi-pair cable into the through bore of the connector; and d) threading the connector onto the end of the multi-pair cable such that a plurality of discrete helical elements of the connector engages the jacket of the cable to prevent inadvertent longitudinal movement of the connector relative to the cable.

2. The method of claim 1 wherein the plurality of discrete helical elements is disposed within the through bore of the connector.

3. The method of claim 2, wherein the plurality of discrete helical elements extends only partly around an inside diameter of the through bore.

4. The method of claim 1, wherein the step of threading includes threading the connector onto the end of the multi-pair cable until a stop provided on the connector limits further threading engagement.

5. The method of claim 4, wherein the stop is provided within the through bore of the connector.

6. The method of claim 4, wherein the jacket surrounding the twisted pairs includes an outer jacket layer and an inner jacket layer, and wherein the step of threading includes threading the connector onto the end of the multi-pair cable until the stop contacts the outer jacket layer.

7. The method of claim 1, further including inserting the twisted pairs through apertures of a wire management insert and attaching the wire management insert to the connector.

8. The method of claim 7, further including inserting prongs of the wire management insert into the through bore of the connector such that the prongs clamp down around the end of the multi-pair cable.

9. The method of claim 7, further including untwisting each twisted pair and placing each individual conductor of the twisted pairs within channels defined by the wire management insert.

10. The method of claim 9, further including trimming ends of the individual conductors placed within the channels of the wire management insert.

11. The method of claim 9, connecting a plug piece to the connector threaded onto the end of the multi-pair cable, the plug piece including a number of contacts corresponding to the number of individual conductors.

12. The method of claim 11, wherein the contacts are insulation displacement contacts.

13. The method of claim 7, wherein the step of attaching includes snap-fitting the wire management insert to the connector.

14. The method of claim 13, further including snap-fitting a plug piece to the connector after snap-fitting the wire management insert to the connector, the plug piece including a connection interface that is electrically connected to the twisted pairs.

15. The method of claim 1, wherein the through bore of the connector defines an un-threaded lead-in, the step of inserting the end of the multi-pair cable including inserting the end of the multi-pair cable into the through bore of the connector such that the end is inserted into the un-threaded lead-in before reaching the helical elements.

* * * * *